United States Patent [19]

Bernhardsson et al.

[11] Patent Number: 4,798,635

[45] Date of Patent: Jan. 17, 1989

[54] FERRITIC-AUSTENITIC STAINLESS STEEL

[75] Inventors: Sven-Olov Bernhardsson; Hans F. Eriksson, both of Sandviken; Sven P. Norberg, Gävle; Lars O. H. Forssell; Nils R. Lindqvist, both of Sandviken, all of Sweden

[73] Assignee: Santrade Limited, Lucerne, Switzerland

[21] Appl. No.: 718,291

[22] Filed: Apr. 1, 1985

[30] Foreign Application Priority Data

Mar. 30, 1984 [SE] Sweden ..... 8401768
May 9, 1984 [SE] Sweden ..... 8401768

[51] Int. Cl.[4] ..... C22C 38/20; C22C 38/22

[52] U.S. Cl. ..... 148/325; 420/60; 420/61; 420/65

[58] Field of Search ..... 148/38, 37, 325; 75/125, 128 N, 128 A; 420/60, 61, 65

[56] References Cited

U.S. PATENT DOCUMENTS 2,624,670 1/1953 Binder et al. ..... 420/35
4,391,635 7/1983 Murakami et al. ..... 148/37

FOREIGN PATENT DOCUMENTS 55-158256 12/1980 Japan ..... 148/38

OTHER PUBLICATIONS

"Use of Duplex Stainless Steels to Retard Stress Corrosion Cracking", P. Combrade, A. Desestret, P. Jolly, and R. Mayoud, National Association of Corrosion Engineers, Copyright 1982, pp. 153–173.

*Primary Examiner*—Melvyn J. Andrews
*Assistant Examiner*—Deborah Yee
*Attorney, Agent, or Firm*—Burns, Doane, Swecker & Mathis

[57] ABSTRACT

The present invention presents a ferritic-austenitic Cr-Ni-N-Steel alloy with a stable austenite phase, high corrosion resistance and good weldability, said steel alloy consisting essentially of the following elements by weight; max 0.06% C, 21–24.5% Cr, 2–5.5% Ni, 0.05–0.3% N, max 1.5% & Si, max 4.0% Mn, 0.01–1.0% Mo, 0.01–1.0% Cu, the remainder being iron and normal impurities, the contents of said elements being balanced so that the ferrite content, $\alpha$, amounts to 35–65%. The analysis of the steel is so optimized that it becomes especially useful for those environments where the steel is exposed to temperatures above 60° C. and chloride amounts up to 1000 ppm while the alloy being stable towards deformation form austenite into martensite at a total deformation oft 10–30% in room temperature.

25 Claims, 2 Drawing Sheets

FERRITIC-AUSTENITIC STAINLESS STEEL

The present invention relates to a ferritic austenitic Cr-Ni-N steel alloy with a stable austenite phase, with good resistance to general corrosion and good weldability. Duplex stainless steels (ferritic-austenitic) have been increasingly demanded in chemical processing industries. Commercially available duplex steels are mainly alloyed with Mo, the reason being those technical difficulties that are inherent with Mo-free duplex stainless steels since they are unable to meet the properties needed in construction materials for instance that no phase deformation should occur when subjecting the material to cold reduction at a moderate degree.

Due to systematic research and development a new type of duplex stainless steel, mainly free from Mo, has been developed which has a controlled and optimized balance of constituents which gives surprisingly good properties.

Figure 1:
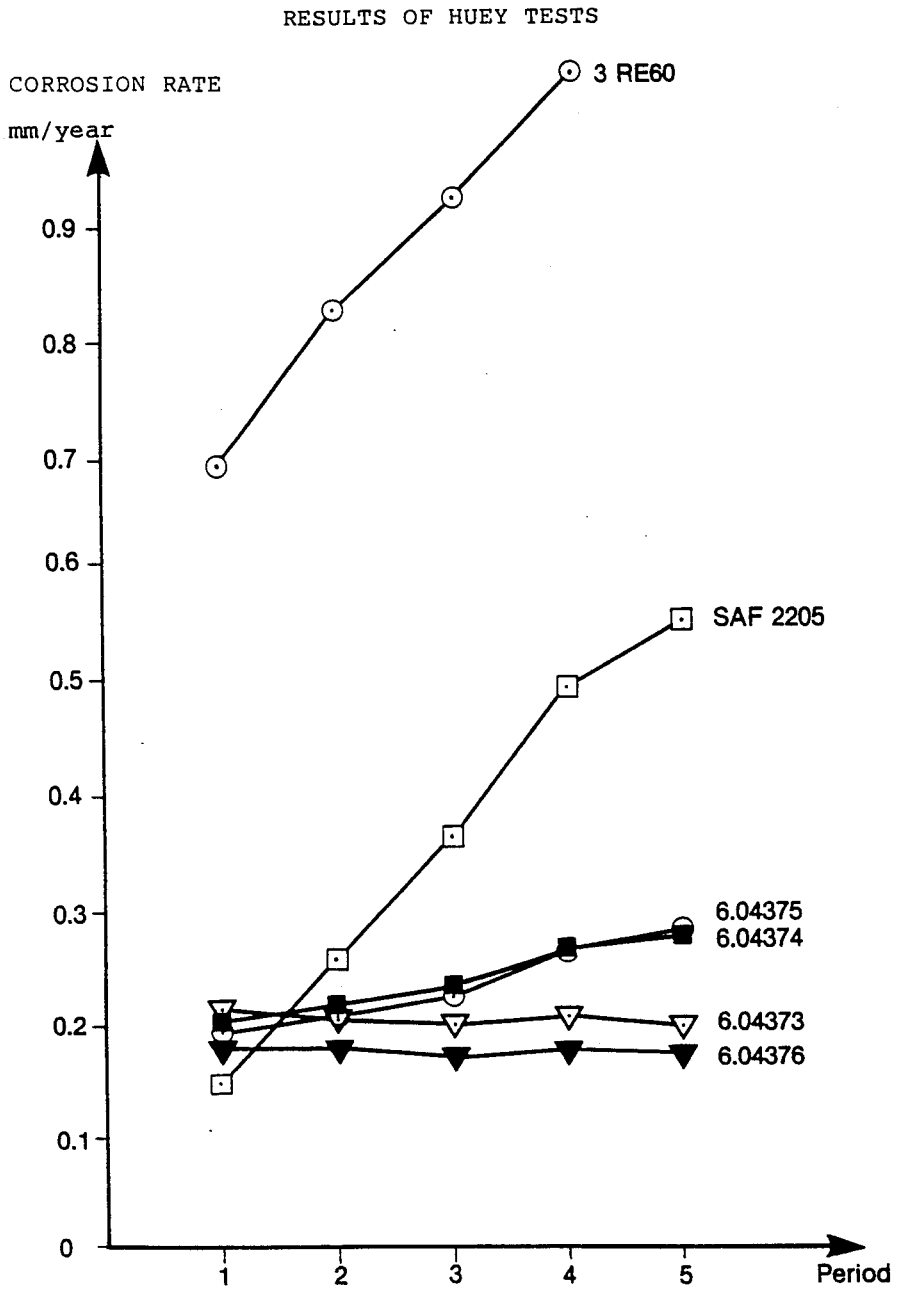
FIG. 1 is a graph which illustrates the results of Huey tests for certain alloys.

The basic composition of the present inventive stainless steel is:

| | |
|---|---|
| C | not more than 0.06% |
| Si | not more than 1.5% |
| Mn | not more than 4.0% |
| Cr | 21.0–24.5% |
| Ni | 2.0–5.5% |
| Cu | 0.01–1.0% |
| N | 0.05–0.3% |

The remainder elements being Fe and unavoidable impurities whereby the constituents are so balanced that the ferrite, $\alpha$, amounts to 35–65 %.

The chemical analysis, by itself, is not sufficient in order to properly define the inventive stainless steel alloy. It is additionally necessary to specify conditions in terms of alloy constituents and chemical microstructure in order to arrive at a complete definition of this steel alloy.

Certain of these conditions are unique and not previously published. One of these conditions stipulates the relation between chromium-, manganese- and nitrogen contents with regard to undesired presence of nitrogen bubbles, i.e. porosity in the material. In order to avoid porosity in the material during ingot production the ratio (Cr+Mn)/N ought to be >120 and preferably >130.

Other conditions are related to the steel alloy's corrosion resistance after welding. In order for the material (=the weld joint at double-sided welding of I-joint and normal heating) to be resistant against intergranular corrosion testing according to ASTM A262 Practice E (Strauss test) the ferrite content (% $\alpha$) should not be too high in order to fulfil the condition $$\alpha \leqq 0.20 \times (\%\ Cr/\%\ N) + 23$$

In order to safely avoid $Cr_2N$ type precipitations in that particular zone which is exposed to maximum temperatures in the range 600°–800° C. during welding as aforesaid the ferrite content should be kept within a more narrow range $$\%\ \alpha \leqq 0.20\ (\%\ Cr/\%\ N) + 8$$

The precipitation can be detected by etching in oxalic acid according to ASTM A262 Practice A.

Deformation of austenite into martensite during bending and rolling operations can lead to increased susceptibility for corrosion, especially stress corrosion. The chemical analysis of the alloy should therefore be balanced so that the austenite phase becomes stable during moderate deformation. Systematic investigations have surprisingly revealed that an increased content of nickel does not lead to significant increased austenite stability. The explanation is most likely that an increased nickel content gives an increased amount of austenite whereby the content of both nickel and chromium in the austenite will decrease. The effect of nitrogen upon the austenite stability is low for the same reason. Manganese, molybdenum and copper will affect the austenite stability but they are present in smaller amounts than chromium in the alloy.

In order to reach austenite stability the analysis of the alloy should be determined by the formula $$22.4 \times \%\ Cr + 30 \times \%\ Mn + 22 \times \%\ Mo + 26 \times \%\ Cu + 110 \times \%\ N > 540$$

The analysis of the inventive alloy should be optimized so that the alloy becomes specifically suitable for use in environments where the material is exposed to temperatures above 60° C. and chlorides in amounts up to 1000 ppm at the same time as the material allows 10–30 % total deformation at room temperature without any pronounced austenite deformation into martensite.

It is essential that the various constituents of the alloy are present in carefully selected amounts.

Carbon increases the austenite amount in the alloy and also increases its strength while stabilizing austenite towards deformation into martensite. The content of carbon therefore should be in excess of 0.005 % by weight. On the other hand carbon has limited solubility in both ferrite and austenite and it can via precipitated carbides negatively affect the corrosion resistance and the mechanical properties. The carbon content should therefore be max 0.05 % and preferably max 0.03 % by weight.

Silicon is an important constituent in order to facilitate the metallurgical production process. Silicon also stabilizes austenite towards a deformation into martensite and increases somewhat the corrosion resistance in many environments. The amount of silicon should therefore be larger than 0.05% by weight. On the other hand silicon reduces the solubility for carbon and nitrogen, acts as a strong ferriteforming element and increases the tendency for precipitation of intermetallic phases. The silicon content should therefore be restricted to max 1.0, preferably max 0.8 percentage by weight.

Manganese stabilizes the austenite towards deformation into martensite and increases the nitrogen solubility in both solid phase and in the melt. The manganese content therefore should be larger than 0.1% by weight. Manganese also decreases the corrosion resistance in acids and in chloride environments and increases the tendency for precipitation of intermetallic phases.

Therefore the content of manganese should be restricted to max. 2.0%, preferably max 1.6% by weight. Manganese does not give any pronounced change of the ferrite/austenite ratio at temperatures above 1000° C.

Chromium is a very important constituent of the alloy with predominantly positive effects but, like other constituents, it also is associated with negative effects. Surprisingly it has been observed that in duplex stainless steels free from molybdenum and with a constant manganese content, chromium is that specific alloying element which mainly determines austenite stability towards deformation into martensite. Chromium also increases nitrogen solubility in the solid phase and in the melt,and it increases the resistance to localized corrosion in chloride-containing solutions and increases the resistance to general corrosion in organic acids Since chromium is a strong former of ferrite large chromium amounts will also lead to the need of large amounts of nickel, which is a strong austenite-forming element, in order to reach optimum microstructure. Nickel is, however, an expensive alloy element which leads to a drastic increase in expense along with an increased chromium content. Chromium also increases the tendency for precipitation of intermetallic phases as well as tendency for 475° embrittlement. The steel alloy of the present invention should therefore contain more than 21% of chromium and less than 24.5%, normally more than 21.5% by weight but simultaneously lower than 24.5%, usually lower than 23.5%. Preferably the chromium content should be in the range 21.0–22.5% by weight.

Nickel is a strong austenite former and a necessary alloy element in order to achieve a balanced analysis and microstructure. The nickel content therefore should be larger than 2.5% by weight. In amounts up to 5.5% nickel also increases the resistance towards general corrosion in acids. By an increased austenite content nickel will indirectly, increase the nitrogen solubility in the solid phase.Nickel is, however, an expensive alloy element and therefore its amount should be restricted. The nickel content should therefore not be more than max 5.5%, normally less than 4.5% and preferably less than 3.5% by weight.

Molybdenum is a very expensive alloy element and the amount thereof should therefore be restricted. Presence of molybdenum in small amounts in this type of alloys, however, has shown to be of advantage for the corrosion properties. The amount of molybdenum therefore should be larger than 0.1%. In order to avoid expenses the content of.molybdenum should not be larger than 0.6%.

Copper has a limited solubility in this type of alloy and its content should therefore not be larger than 0.8%, preferably not larger than 0.7%. Our investigations have indicated that in basically molybdenum-free duplex steel alloys with a high Cr/Ni-ratio and additions of nitrogen a low content of copper will result in a highly improved resistance towards corrosion in acids. Copper also stabilizes the austenite phase towards deformation into martensite. The copper amount in the alloy should therefore be larger than 0.1% and preferably larger than 0.2%. More specifically, a combination of low amounts of copper plus molybdenum will result in a remarkable increase of the corrosion resistance of the alloy in acids. Therefore, the sum of copper +molybdenum contents should be at least 0.15% of which copper amounts to at least 0.05%.

Nitrogen has a plurality of effects in this type of steel alloys. Nitrogen stabilizes austenite towards deformation into martensite, nitrogen is a strong austenite former and nitrogen also results in a surprisingly rapid reformation of austenite in the high temperature affected zone in connection with welding. The amount of nitrogen should preferably be 0.06–0.12%. The presence of too high amount of nitrogen in relation to the remainder of alloying elements could, however, result in porosity in connection with ingot production and welding. The amount of nitrogen therefore should be max 0.25%.

The experience from ferritic-austenitic stainless steels containing molybdenum shows that a nitrogen content of more than 0.10% is needed in order to bring about a rapid reformation of austenite in the high temperature heat affected zone in connection with welding. The obtained results surprisingly have shown that in ferritic-austenitic stainless steels with low content or no content of molybdenum the reformation occurs much more rapidly. The conclusion from these investigations is that molybdenum affects the kinetics for reformation of austenite, and that a nitrogen content lower than 0.10% could result in a rapid reformation of austenite whereby said nitrogen content should be at least 0.06%.

With high contents of nitrogen in the alloy chromium nitrides will, in connection with welding, precipitate in the low temperature heat affected zone. Since this could negatively affect the material properties in certain applications the amount of nitrogen should be restricted to amounts less than 0.25%, preferably less than 0.20%.

The following example will give the results that have been obtained at corrosion tests of an alloy according to the present invention. The alloy (steel No. 1) was compared with a corresponding alloy essentially free from copper and molybdenum, and also with standard alloys containing higher amounts of nickel, i.e. more expensive alloys than compared with the present inventive alloy. The analysis of the testing materials appears from Table I below.

TABLE I

Chemical analysis of testing material

| Alloy No. | | C | Si | Mn | P | S | Cr |
|---|---|---|---|---|---|---|---|
| 1 | (present invention) | 0.02 | 0.5 | 1.5 | <0.035 | <0.010 | 22.2 |
| 2 | | 0.02 | 0.5 | 1.5 | <0.035 | <0.010 | 22.4 |
| 3 | (AISI 304) | 0.04 | 0.6 | 1.25 | <0.030 | <0.010 | 18.4 |
| 4 | (AISI 316) | 0.045 | 0.6 | 1.7 | <0.030 | <0.010 | 17.0 |

| | | Ni | Mo | Cu | N | Fe |
|---|---|---|---|---|---|---|
| 1 | (present invention) | 3.3 | 0.25 | 0.25 | 0.15 | rest |
| 2 | | 3.5 | 0.03 | 0.02 | 0.14 | rest |
| 3 | (AISI 304) | 9.3 | <0.6 | <0.5 | 0.06 | rest |
| 4 | (AISI 316) | 13.0 | 2.6 | <0.5 | 0.07 | rest |

Production of the testing material included melting and casting at about 1600° C. followed by heating to 1200° C. and then forging the material into bars. The material was then subjected to hot working by extrusion at about 1175° C. From this material test samples were taken for various tests. The material was finally subjected to quenching from 1000° C. The corrosion resistance in acids has been investigated by measuring polarization curves in 1M $H_2SO_4$, RT, 20 mV/min. where RT stands for room temperature, and by weight loss measurements in 5% $H_2SO_4$ and 50 % acetic acid. The results herefrom appears in Table II below.

TABLE II

| Alloy No. | Results of corrosion tests: Corrosion rate, mm/year: 5% $H_2SO_4$, 40° C. | 50% HAC, boiled | I max, mA/cm$^2$ 1M $H_2SO_4$ |
|---|---|---|---|
| 1 | 0.03 | 0 | 1.4 |
| 2 | 1.0 | 0.1 | 4 |
| 3 | 0.5 | 0.5 | 3 |
| 4 | 0 | 0 | — |

From the results obtained it appears that the corrosion resistance of alloys according to the present invention in both strong and weak acids are remarkably better than compared with an alloy containing about 9% nickel. In weak acids said resistance was essentially the same as for a highly alloyed steel (17% Cr, 13% Ni, 2.6% Mo). The results also show that in order to obtain good corrosion resistance in acids it is necessary that the alloy contains a certain amount of molybdenum and copper. Systematic testing of alloys with various contents of molybdenum and copper has shown that an amount of more than 0.1% copper or molybdenum results in good corrosion resistance in this type of alloys, especially for those where the sum of molybdenum and copper contents is larger than 0.15% of which the copper content amounts to at least 0.05%.

In the following is disclosed those results that were obtained from Huey-testing, i.e. investigation of the corrosion rate in boiling 65%-concentrated nitric acid in 5 periods of each 48 hours. The corrosion rate in mm/year has been measured after each such time priod. The results therefrom are obtained from testing alloys of the invention produced exactly as those listed in Table I and also from testing two commercially available ferritic-austenitic alloys with designations SAF 2205 and 3RE60.

TABLE III

Chemical analysis of testing material

| Alloy No. | C | Si | Mn | P | S | Cr |
|---|---|---|---|---|---|---|
| 373 | 0.008 | 0.49 | 1.11 | 0.022 | <0.003 | 21.77 |
| 374 | 0.010 | 0.53 | 1.09 | 0.026 | <0.003 | 22.88 |
| 375 | 0.010 | 0.51 | 1.09 | 0.027 | <0.003 | 23.12 |
| 376 | 0.009 | 0.49 | 1.05 | 0.023 | <0.003 | 22.99 |
| SAF 2205 | 0.016 | 0.35 | 1.65 | 0.024 | <0.003 | 21.96 |
| 3RE60 | 0.018 | 1.61 | 1.50 | 0.026 | 0.005 | 18.42 |

| | Ni | Mo | Cu | N |
|---|---|---|---|---|
| 373 | 4.13 | 0.11 | 0.20 | 0.13 |
| 374 | 3.15 | 0.12 | 0.21 | 0.25 |
| 375 | 3.16 | 0.11 | 0.21 | 0.18 |
| 376 | 4.02 | 0.11 | 0.20 | 0.18 |
| SAF 2205 | 5.53 | 2.98 | 0.08 | 0.15 |
| 3RE60 | 4.86 | 2.71 | 0.06 | 0.078 |

TABLE IV

Results from Huey-testing of welds

| Alloy No. | Pitting mm/year | Max. attack depth, μm // rolling direction: base material | weld material | ⊥ rolling direction: base material | weld material |
|---|---|---|---|---|---|
| 373 | 0.22 | 56 | 20 | 18 | 52 |
| 374 | 0.26 | 116 | 32 | 44 | 36 |
| 375 | 0.24 | 116 | 32 | 50 | 60 |
| 376 | 0.19 | 48 | 24 | 30 | 36 |
| SAF 2205 | 0.37 | 30 | 100 | 30 | 36 |
| 3RE60 | 0.95 | 66 | 100 | 56 | 180 |

The obtained results clearly show that the properties of the alloy of the invention is definitely superior compared with properties of commercially available duplex alloys type 3RE60 and SAF 2205 which both have higher contents of both nickel and molybdenum.

Figure 2:
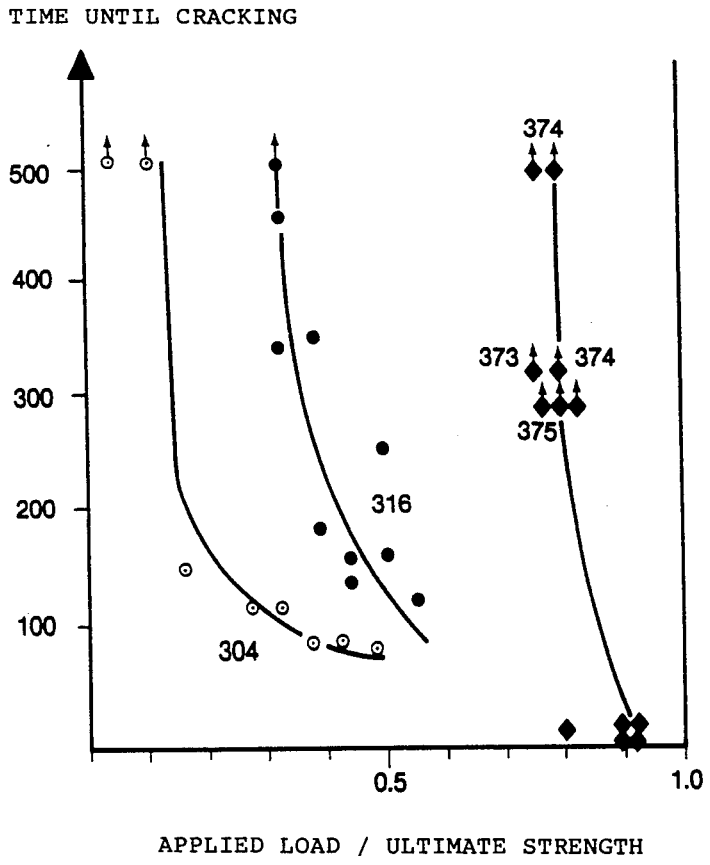
FIG. 2 is a graph which illustrates the results of stress corrosion tests for certain alloys.

In connection with FIG. 1 is illustrated the average corrosion rate in connection with Huey-testing as a function of each additional 48 h-period. Resistance to stress corrosion Q has also been investigated by subjecting the material to a constant load in 40% $CaCl_2$, 100°, pH=6.5. The time until cracking occurred was measured of both the heats listed in Table I and heats of the commercially available alloys AISI 304 and AISI 316 and also for alloys 373, 374, 375 and 376 according to the invention. The results in terms of time to cracking are illustrated in FIG. 2. As appears therefrom in average about 80% of the load subjected to the alloys of the present invention could be maintained whereas the load subjected to the commercial alloys AISI 304 and AISI 316 had to be decreased with 50% or even more.

We claim:

1. Ferritic-austenitic steel alloy having high resistance to corrosion and good weldability, the austenite phase of which beign stable towards cold deformation in the range between 10 and 30% said steel consisting essentially of the following elements by weight:

C, a maximum of 0.06%
Si, 1.5%
Mn, 2.0%
Cr, from 21.5% to 24.5%
Ni, from 2.5% to 5.5%
Mo, from 0.01% to 1.0%
Cu, from 0.01% to 1.0%
N, from 0.05% to 0.3% the remainder of said composition iron and normal impurities, the contents of said elements being balanced so that following conditions are fulfilled:

ferrite content, $\alpha$, is between 35% and 65%
percentage of ferrite % $\alpha \leqq 0.20 \times (\%\ Cr/\%\ N)+23$ to obtain good properties after welding
(% Cr+% Mn)/% N shall be >120 to avoid porosities during casting
$22.4 \times \%\ Cr + 30 \times \%\ Mn + 22 \times \%\ Mo + 26 \times \%\ Cu + 110 \times \%\ N > 540$ to maintain austenite stability,
% Mo+% Cu≧0.15 whereby % Cu shall be at least 0.05%, and
precipitated carbides and nitrides are essentially avoided.

2. The steel of claim 1, characterized in that the amount of the elements are so mutually balanced that the ferrite content, $\alpha$, fulfils the condition % $\alpha \leqq 0.20 \times (\%\ Cr/\%\ N)+8$.

3. The steel of claim 2, characterized in that the amount of carbon is max 0.05%.

4. The steel of claim 3, characterized in that the amount of silicon is max 1.0%.

5. The steel of claim 4, characterized in that the amount of chromium is in the range 21.0–24.0%.

6. The steel of claim 5, characterized in, that the amount of chromium is 21.5–23.5%.

7. The steel of claim 6, characterized in, that the amount of chromium is 21.5–22.5%.

8. The steel of claim 7, characterized in, that the amount of nickel is 2.5–4.5%.

9. The steel of claim 8, characterized in that the amount of nickel is less than 3.5%.

10. The steel of claim 9, characterized in that the amount of nitrogen is max 0.25%.

11. The steel of claim 10, characterized in that the amount of nitrogen is 0.06–0.12%.

12. The steel of claim 11, characterized in that the amount of copper is 0.1–0.7%.

13. The steel of claim 12, characterized in that the amount of molybdenum is 0.1–0.6%.

14. The steel of claim 13, characterized in that the accumulated sum of copper and molybdenum is 1.0%.

15. The ferritic-austenitic steel alloy as defined in claim 14 wherein the alloy is capable of withstanding environments where the alloy is exposed to temperatures above 60° C. and chloride in amounts up to 1000 ppm and the alloy being stable towards deformation from austenite into martensite at a total deformation of 10–30% in room temperature.

16. The steel of claim 1, characterized in that the amount of carbon is max 0.05%.

17. The steel of claim 1, characterized in that the amount of silicon is max 1.0%.

18. The steel of claim 1, characterized in, that the amount of nickel is 2.5–4.5%.

19. The steel of claim 1, characterized in that the amount of nitrogen is max 0.25%.

20. The steel of claim 1, characterized in that the amount of copper is 0.1–0.7%.

21. The steel of claim 1, characterized in that the amount of molybdenum is 0.1–0.6%.

22. The steel of claim 1, characterized in that the accumulated sum of copper and molybdenum is 1.0%.

23. The steel of claim 1, characterized in that the amount of carbon is max 0.03%.

24. The steel of claim 1, characterized in that the amount of silicon is max 0.85.

25. The ferritic-austenitic steel alloy as defined in claim 1 wherein the alloy is capable of withstanding environments where the alloy is expossed to temperatures above 60° C. and chloride in amounts of up to 1000 ppm and the alloy being stable towards deformation from austenite into martensite at a total deformation of 10–30% in room temperature.

* * * * *

UNITED STATES PATENT AND TRADEMARK OFFICE

CERTIFICATE OF CORRECTION

PATENT NO. : 4,798,635

DATED : Jan. 17, 1989

INVENTOR(S) : Bernhardsson et al.

It is certified that error appears in the above-identified patent and that said Letters Patent is hereby corrected as shown below:

Column 6, line 26, "Si, 1.5%" should read -- Si, -"- 1.5% --;
line 27, "Mn, 2.0%" should read -- Mn, -"- 2.0% --;
Column 8, line 14, "0.85" should read -- 0.8% --.

Signed and Sealed this

Fifth Day of December, 1989

*Attest:*

JEFFREY M. SAMUELS

*Attesting Officer* *Acting Commissioner of Patents and Trademarks*